US005497686A

United States Patent [19]

Mohr

[11] Patent Number: 5,497,686

[45] Date of Patent: Mar. 12, 1996

[54] DEVICE FOR OPTIMIZING THE UNPRODUCTIVE MOTIONS OF THE HOLDFAST BEAM IN A MACHINE THAT CUTS MATERIAL

[76] Inventor: Wolfgang Mohr, Hundshager Weg 42, D-65719 Hofheim/Taunus, Germany

[21] Appl. No.: 112,899

[22] Filed: Aug. 27, 1993

[30] Foreign Application Priority Data

Aug. 28, 1992 [DE] Germany ..... 42 28 649.2

[51] Int. Cl.[6] ..... B26D 7/02

[52] U.S. Cl. ..... 83/282; 83/364; 83/365; 83/461; 83/466

[58] Field of Search ..... 83/72, 74, 248, 83/282, 361, 365, 375, 452, 461, 466, 934, 364

[56] References Cited

U.S. PATENT DOCUMENTS

| | | | |
|---|---|---|---|
| 3,182,542 | 5/1965 | Cochran | 83/466 X |
| 4,674,378 | 6/1987 | Kawano et al. | 83/365 X |
| 4,757,731 | 7/1988 | Mohr | 83/72 X |
| 4,836,074 | 6/1989 | Mohr | 83/282 X |

FOREIGN PATENT DOCUMENTS

| | | |
|---|---|---|
| 1095254 | 12/1960 | Germany . |
| 1190431 | 4/1965 | Germany . |

*Primary Examiner*—Richard K. Seidel
*Assistant Examiner*—Raymond D. Woods
*Attorney, Agent, or Firm*—Max Fogiel

[57] ABSTRACT

An arrangement for optimizing the unproductive motions of a holdfast-beam in a machine that cuts sheets of material that are stacked on a bench. A hydraulic beam descends onto the stack of sheets to hold them fast before they are cut, and rises again after the sheets have been cut. A definite distance between the holdfast-beam and the material that has been cut is determined while the beam rises off the sheets of material. The rise of the holdfast-beam is terminated when a definite distance is determined.

6 Claims, 3 Drawing Sheets

DEVICE FOR OPTIMIZING THE UNPRODUCTIVE MOTIONS OF THE HOLDFAST BEAM IN A MACHINE THAT CUTS MATERIAL

BACKGROUND OF THE INVENTION

The present invention concerns a method of and device for optimizing the unproductive motions of the holdfast beam in a machine that cuts material, especially stacked sheets of paper, cardboard, etc.

In a known machine for cutting such material the sheets are stacked on a bench and a hydraulic beam descends onto the stack to hold it fast. Once the cut has been produced, the beam rises into an invariable upper position. The distance between the holdfast beam in that position and the surface of the bench slightly exceeds maximal height of the stack of material.

There is a drawback to such a machine in that the holdfast beam executes unproductive motions when a low stack is processed. Considerable time is lost while the beam descends onto the stack from its upper position. Raising the beam to its upper position once the cut has been produced also takes considerable time. These long intervals considerably decelerate the overall process when the machine is operating automatically, The material cannot be advanced along the surface until the beam is all the way up. The blade's and the beam's unproductive motions can in particularly last longer than it takes to advance a stack of small sheets, labels for example.

German AS 1 190 431 discloses not raising the hydraulically operated beam and blade in a machine that cuts material, especially stacked sheets of paper, cardboard, or similar material as unprofitably high as is necessary in a machine that is driven by a crankshaft. The material can accordingly be advanced in this embodiment as soon as the blade and beam release the stack.

German AS 1 095 254 discloses switching circuitry for a machine that cuts material, especially stacked sheets of paper, cardboard, or similar material with a blade-accommodating beam and a mechanically controlled automatically operated holdfast beam. The holdfast beam is lifted out of the position in which it holds down the material by a device that actuates the beam's mechanisms and responds to the arrival of the blade-accommodating beam at a specific elevation. The device comprises a switch that includes a roller and a sloping surface that the roller rolls over, controlling the switch. The holdfast pressure is removed when the blade rises above the stack, which is precisely when the holdfast beam begins to rise. The upward motion of the holdfast beam is accordingly dictated by the upward motion of the blade, but the distance traveled by the holdfast beam is not dictated by the height of the stack.

SUMMARY OF THE INVENTION

The object of the present invention is a method of and device for optimizing the unproductive motions of the holdfast beam in a machine that cuts material.

The method of optimizing the unproductive motions of the holdfast beam in a machine that cuts material, whereby the sheets are stacked on a bench and a hydraulic beam descends onto the stack to hold it fast before the material is cut and rises again after the material has been cut is characterized in that a definite distance between the holdfast beam and the material that has been cut is determined while the beam is rising off the material and the rise of the holdfast beam is terminated while the definite distance is being determined or thereafter. It is accordingly ensured that the holdfast beam will rise once the material has been cut only as high as is necessitated by the height of the stack of material that has already been cut and will descend onto the next material to be cut from that same height, assuming that the height of the stack remains constant, before the next material is cut, whereby the rise of the holdfast beam is immediately terminated while the prescribed distance between the material that has not yet been cut and the holdfast beam is being determined or a timer that terminates the rise of the holdfast beam is actuated. The interposition of a timer is particularly significant given that the hardness of the material being cut can vary. When the material is hard, accordingly, the rise of the holdfast beam can be relatively brief, whereas, when the material is soft and tends to expand when the holdfast beam rises, the rise will need to be longer. If on the other hand the rise of the holdfast beam is terminated immediately while the definite distance is being determined, the hardness of the material being cut can as a rule be ignored.

The method in accordance with the invention makes it possible to commence advancement of the material being cut as soon as the definite distance between the holdfast beam and the material has been determined. The unproductive motions of the material-cutting machine in automatic operation can accordingly be considerably decreased. Time is also saved in that the holdfast beam will need to descend from a lower level onto the material being cut.

It if of advantage for the rise of the holdfast beam to terminate when the distance between the holdfast beam and the material being cut is between 10 and 20 mm. The risen holdfast beam will accordingly be at least 10 mm above the material being cut, ignoring the expansion of the material one the holdfast beam has risen. If a timer is employed, the definite distance can be shorter in order to ensure that the rise of the holdfast beam terminates 10 to 20 mm from the material being cut.

It is preferable for the definite distance between the lower edge of the holdfast beam and the upper edge of the stack of material being cut to be determined by a pick-up mounted stationary on the holdfast beam and following it as it rises. Since it is mounted stationary on the holdfast beam, the pick-up will rise to the same extent and will accordingly sense, due to its following the holdfast beam, the position of the top of the stack and in concrete terms accordingly the transition between the top of the stack and the air. As soon as the pick-up senses the top of the stack, the rise of the holdfast beam terminates or the timer that terminates the rise of the holdfast beam is actuated. The latter operation will result in a definite entrainment on the part of the holdfast beam. In addition to continuous determination of the position of the lower edge of the holdfast beam in relation to the top of the stack it is also possible to discontinuously determine their positions by way of several stationary determination sites that can be employed to determine the position of the holdfast beam, especially the lower edge of the holdfast beam and the top of the stack. The precision of the distances between adjacent stationary determination sites makes it possible to predict the particular height of the stack, the distance, that is, between the top of the stack and the surface of the bench, as well as the distance between a mark on the holdfast beam, especially on the lower edge of the holdfast beam, and the surface of the bench. This distance can then be employed to obtain information about the distance between the lower edge of the holdfast beam and the top of the stack. The rise of the holdfast beam is terminated or the timer that terminates the rise of the holdfast beam is actuated once the holdfast beam and stack of material have attained the definite and prescribed distance.

A preferred device that cuts stacked sheets of material has a bench for the material being cut to rest on, a mechanism that advances the material being cut, a hydraulically actuated beam that descends on the material being cut to hold it fast, an adjacent guillotine blade that descends perpendicularly to the surface and cuts the material, and a sensor that operates in conjunction with the circuitry that controls the holdfast-beam hydraulic system. The device is characterized in that the sensor is below the holdfast beam and outside its effective surface, the surface, that is, that comes into contact with the material being cut, whereby the effective distance of the sensor from the holdfast-beam effective surface equals the definite distance at which the sensor will emit a signal that results in immediate or delayed termination of the rise of the holdfast beam. The sensor detects the upper edge of the stack of material being cut, and its effective line or effective plane parallels the effective surface of the holdfast beam. The effective distance between the sensor and the effective holdfast-beam surface equals the definite distance between the lower edge of the holdfast beam and the upper edge of the stack of material being cut where the rise of the holdfast beam terminates or the timer that terminates the rise of the holdfast beam is actuated. In this version of the device, wherein the sensor travels along with the holdfast beam, the sensor will basically have one component at one end of the holdfast beam and another component at the other end. The sensor will accordingly detect the material being cut between its two components. The sensor itself can be of different types, a light barrier comprising a source of light and a photocell for example.

It is convenient for the sensor to be positioned not only outside the holdfast beam but also outside the surface of the bench. The holdfast beam can accordingly descend to the surface of the bench without the surface, if of the conventional type, damaging the sensor. It would basically alternatively be possible to position the sensor above the bench surface and remove material from the surface to accommodate the sensor where it would collide with the surface when the holdfast beam is all the way down. It would in this case be necessary of course to keep any material being cut out of the range of the sensor.

In another preferred embodiment of the device the holdfast beam is accommodated in a guillotine bent that has sensors at various distances above the surface of the bench, each sensor acting parallel to that surface, to determine the elevation of the top of the stack and the lower edge of the holdfast beam in relation to the surface, whereby, when there are non-actuated actuated sensors over a definite distance, the rise of the holdfast beam is terminated immediately or later.

It is practical in this version as well for the sensors to be light barriers.

Further characteristics of the invention will be evident from the following specification and figures. All characteristics and combinations thereof are essential to the invention.

BRIEF DESCRIPTION OF THE DRAWINGS

Two embodiments of the invention will now be specified by way of example and without being limited to them in any way with reference to the drawing, wherein.

DESCRIPTION OF THE PREFERRED EMBODIMENTS

Figure 1:
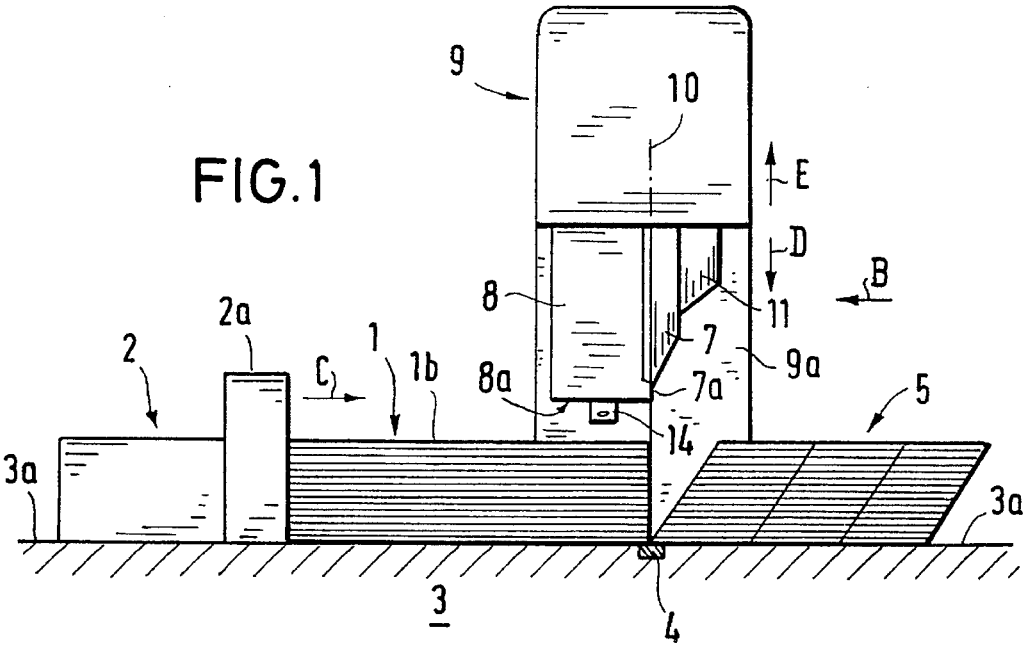
FIG. 1 is a schematic section along the line A—A in FIG. 2 through the top of a machine that cuts stacks of material, whereby the holdfast beam has a light barrier.
Figure 2:
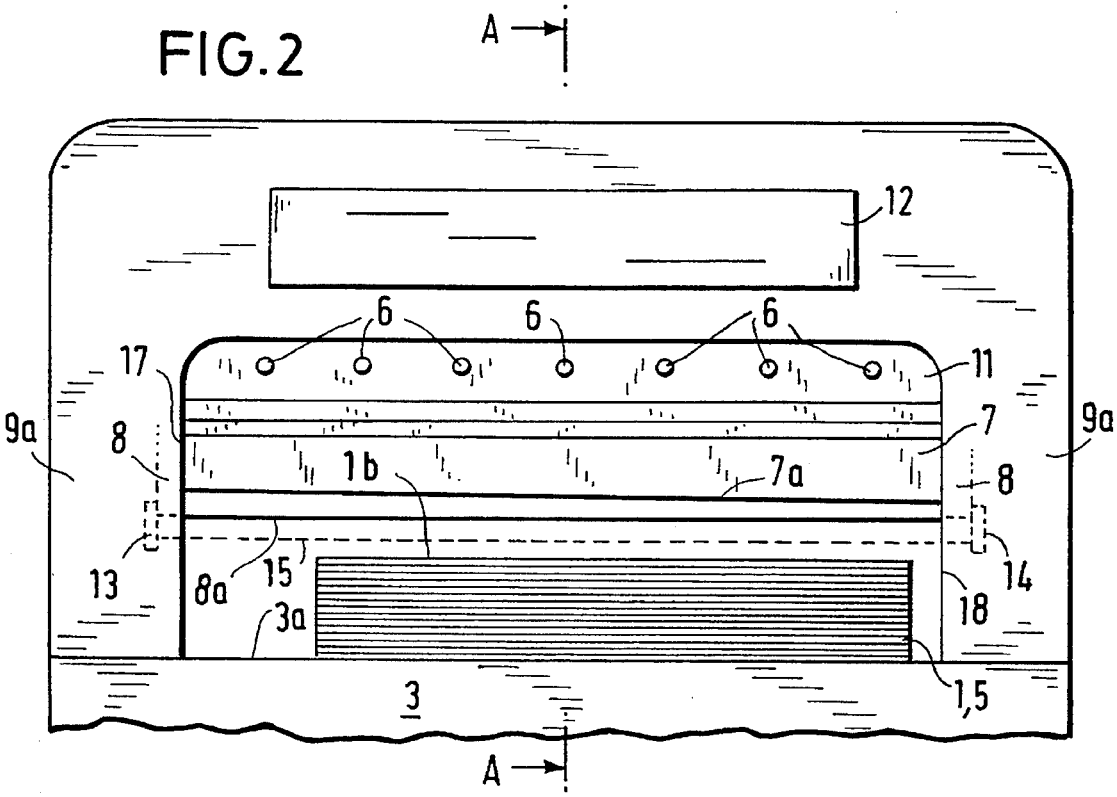
FIG. 2 is a front view of the machine from the direction indicated by arrow B in FIG. 1.
Figure 3:
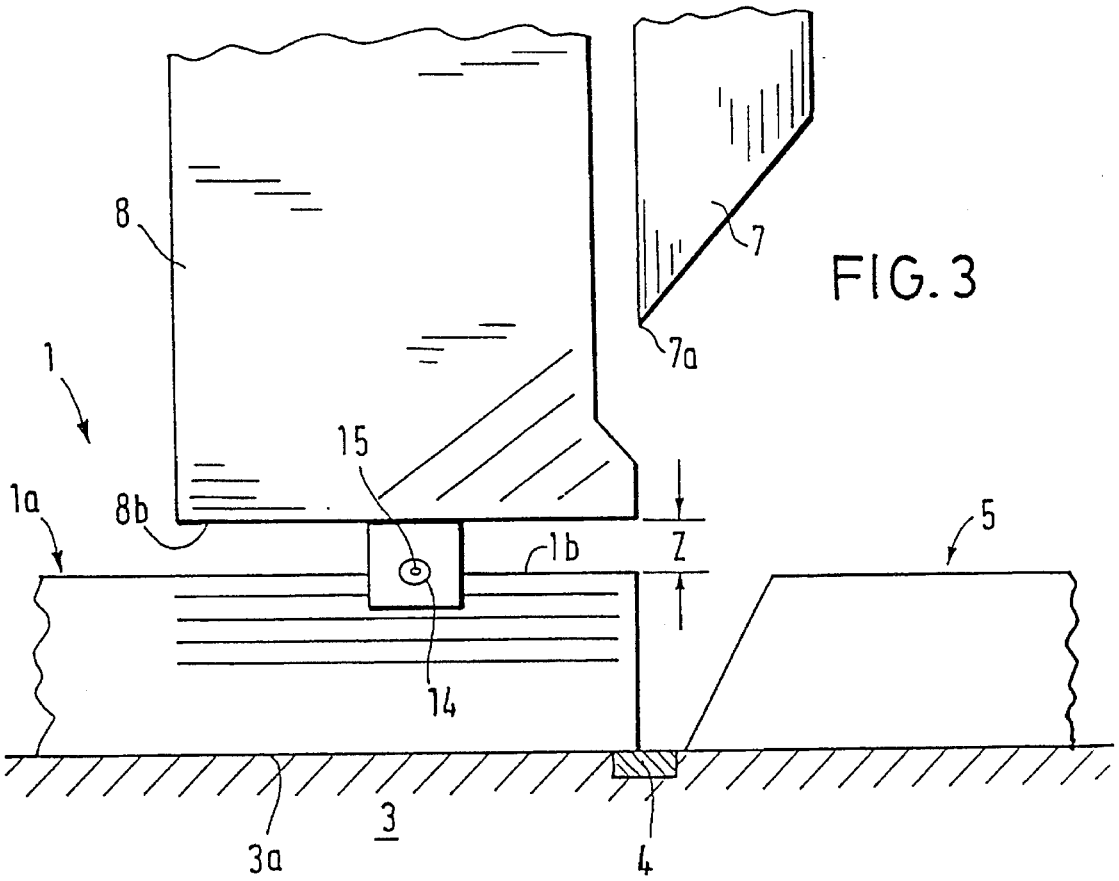
FIG. 3 is a detail of the actual material-cutting point in the machine illustrated in FIG. 1 with a low stack.
Figure 4:
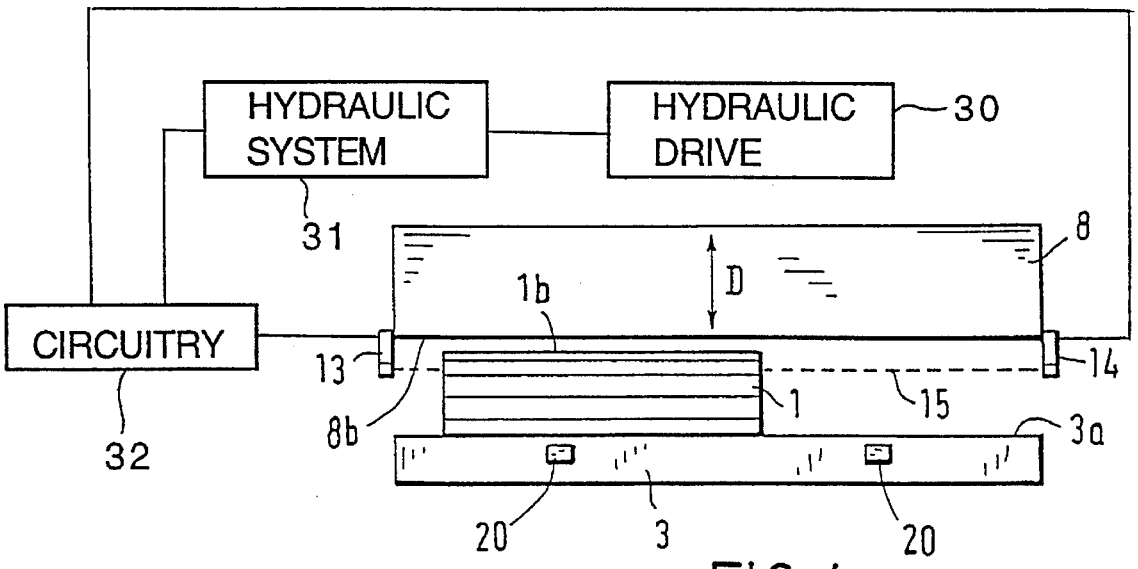
FIG. 4 is a front view of the components of the machine relevant to the method in accordance with the invention.

FIGS. 1 and 2 are highly schematic illustrations of the top of a guillotine-type machine for cutting material, especially stacked sheets of paper, cardboard, or similar material. The machine rests on an unillustrated base. The base accommodates a bench 3 for the stack to rest on and a guillotine bent 9. Embedded in and extending all the way across bench 3 is a blade-edge protector 4. Also extending all the way across the bench is a material-advancing mechanism 2 with a thruster 2*a*. Thruster 2*a* can be forwarded in the direction indicated by arrow C to produce the overall motion of the material while it is being cut. Upstream of blade-edge protector 4, the material 1 that is to be cut rests on the surface 3*a* of bench 3 and against thruster 2*a*. Downstream of blade-edge protector 4 is the material 5 that has been cut, in the form of three advanced stacks. Above blade-edge protector 4 is a blade 7, which is illustrated raised in FIGS. 1 and 2 and can descend as far as blade-edge protector 4 in the direction indicated by arrow D. Adjacent to blade 7 on the side facing material-advancing mechanism 2 is a holdfast beam 8, which is also illustrated raised in FIGS. 1 and 2 and can descend onto the material 1 that is to be cut. Blade 7 and holdfast beam 8 are accommodated in the machine's bent 9, which surrounds them at the top and sides. Blade 7 is fastened by screws FIG. 6 to a blade holder 11 in the form of a beam. The sharp edge 7*a* of blade 7 is at a slight angle to the horizontal. An unillustrated crankshaft moves blade 7 in an oblique shearing stroke. Holdfast beam 8 is mounted with each end in one of the uprights 9*a* of bent 9 and can be moved up and down therein in the direction indicated by arrow D by a hydraulic drive 30 (FIG. 4). Blade 7 is mounted in blade holder 11 in the horizontal web 9*c* of bent 9. The slightly arched tracking of blade 7 is accomplished by way of unillustrated slides. Blade 7 separates the material along a plane 10 perpendicular to the surface 3*a* of bench 3 and extending through blade-edge protector 4. The machine is controlled from a panel 12.

The known embodiment of a guillotine-type machine hereintofore specified and illustrated in FIGS. 1 through 4 has a sensor in the form of a light barrier comprising a source 13 of light and a photocell 14 below the material-contact surface 8*a* of holdfast beam 8. Source 13 of light and photocell 14 are positioned at opposite ends of holdfast beam 8 and accordingly beyond its material-contact surface 8*a*. Source 13 of light, photocell 14, and holdfast beam 8 are represented in FIG. 2 by broken lines in the vicinity of the uprights 9*a* of bent 9. The light 15 emitted by source 13 of light extends horizontally at a specific distance Z below the material-contact surface 8*a* of holdfast beam 8.

Cutting can be initiated by pressing two buttons 20 on the front of bench 3. Holdfast beam 8 descends onto the material 1 that is to be cut. The light barrier is electrically connected during the cutting process and specifically once holdfast beam 8 has descended onto material 1 to the hydraulic mechanism that actuates the beam and is accordingly actuated when the material obstructs light 15. Once the holdfast beam and hence the light barrier have risen until light 15 is no longer obstructed by the material 1 to be cut, which also indicates the definite distance Z between holdfast beam 8 and the material 1 that is to be cut, the light barrier is disengaged and the rise of holdfast beam 8 terminated, either immediately or later by the timer, once the definite distance has been determined. Since the light 15 in the light barrier follows the material-contact surface 8*a* of holdfast beam 8 at effective distance Z as the beam rises in the direction indicated by arrow E, the signal to immediately or subsequently terminate the rise of holdfast beam 8 will not be emitted until the distance between the material-contact surface 8*a* of holdfast beam 8, which is also the lower edge 8*b* of holdfast beam 8, and the top 1*a* of the material 1 that is to be cut, which is also the upper edge 1*b* of the stack of material 1 being cut equals effective distance Z.

The distance between light barrier 15 and the lower edge 8*b* of holdfast beam 8 in the illustrated example is 10 mm. If the light barrier is designed to ensure that emitting the signal will immediately terminate the rise of holdfast beam 8, reduction will occur when holdfast beam 8 is 100 mm from the material 1 to be cut. If a timer is also included, the rise of holdfast beam 8 will not be terminated until the distance to the material to be cut is longer. Although effective distance Z, or the delay, should basically be selected in relation to the practical circumstances, it is decisive in accordance with the present invention that it is no longer necessary to return holdfast beam 8 to its uppermost possible position.

Figure 5:
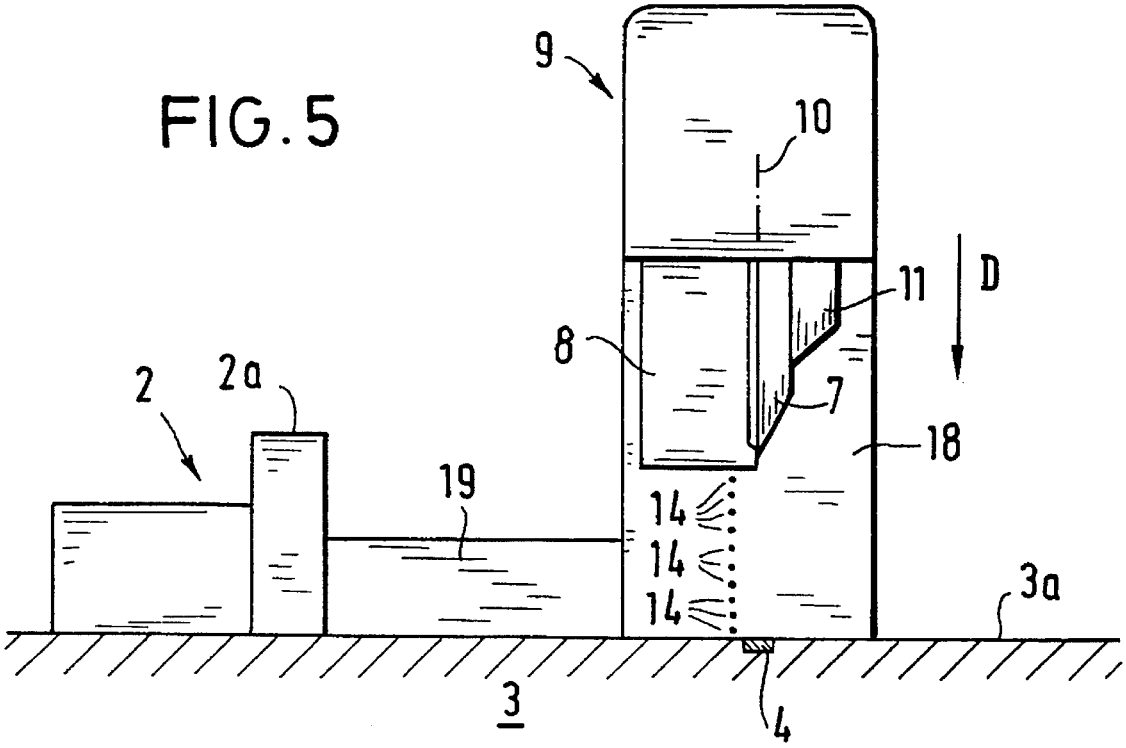
FIG. 5 is a section similar to FIG. 1 of a machine with several light barriers in its bent.

FIG. 5 illustrates another embodiment with several horizontally active light barriers in the vicinity of the inner surfaces 17 and 18 of bent 9 instead of a single horizontally acting light barrier secured to the bottom of holdfast beam 8 (cf. also FIG. 2). The material is, in order to facilitate comprehension of the overall machine, not illustrated. Mounted on bench 3 is a lateral baffle 19. FIG. 5 illustrates a column of uniformly distributed photocells 14. There are similar sources of light distributed along the inner surface 17 of bent 9. When a stack of material 1 is positioned for cutting on the surface 3*a* of bench 3, one or more of the light barriers associated with holdfast beam 8 will be actuated in accordance with the height of the stack. Again, the light barriers between the material-contact surface 8*a* of holdfast beam 8 and the top 1*a* of the material that is to be cut will be deactivated as holdfast beam 8 rises off the stack in the direction indicated by arrow E. The number of not actuated light barriers represents the distance between the holdfast beam 8 and the top 1*a* of the material 1 that is to be cut. The electric circuitry 32 (FIG. 4) that operates in conjunction with the hydraulic system 31 actuating holdfast beam 8 is designed in this embodiment such that in the presence of a definite distance, meaning in the event that a section of light barriers representing distance Z as a definite distance is not actuated, the rise of holdfast beam 8 will be terminated immediately or subsequently. Components similar to those illustrated in FIGS. 1 through 4 are labeled with the same numbers in FIG. 5, and the various embodiments function similarly unless otherwise specified.

It is preferable for material-advancing mechanism 2 to be actuated as soon holdfast beam 8 is at definite distance Z above the material to be cut.

Once the material has been cut, blade 7 will return to its upper and disengaged position ahead of holdfast beam 8 and, once the total stack has been processed, material-advancing mechanism 2 will return to its starting position.

I claim:

1. An arrangement for cutting stacked sheets of material, comprising a bench with a planar surface for the material to be cut to rest on; a hydraulically actuated holdfast beam descending on the material to be cut to hold the material fast; a hydraulic system for actuating said beam; a guillotine blade descending perpendicularly to said planar surface and cutting the material; means for advancing the material to be cut relative to said guillotine blade; a sensor operating in conjunction with circuitry controlling the hydraulic system; said sensor being spaced from the holdfast beam and from an effective surface of said holdfast beam coming into contact with the material being cut, said sensor emitting a signal for terminating rise of said holdfast beam when an effective distance of said sensor from said material is equal to a definite distance.

2. An arrangement for cutting defined in claim 1, wherein said sensor has one component at one end of said holdfast beam and another component at another end of said hold-fast-beam.

3. An arrangement for cutting as in claim 1, wherein the sensor is positioned outside said planar surface of the bench.

4. An arrangement for cutting as defined in claim 1, wherein said sensor comprises a light barrier having a source of light and a photocell.

5. An arrangement for cutting stacked sheets of material in a stack having a top and a height of said top, comprising: a bench with a surface for the material to be cut to rest on; a hydraulically actuated holdfast beam descending on the material to be cut to hold said material fast; a hydraulic system for actuating said beam; a guillotine with a guillotine blade descending perpendicularly to said surface and cutting the material; means for advancing the material to be cut relative to said guillotine blade; and sensors operating in conjunction with circuitry controlling the hydraulic system; said holdfast beam being accommodated in a bent of said guillotine having said sensors at various distances above said surface of said bench, each of said sensors acting parallel to said surface to determine the height of the top of said stack and an edge of said holdfast beam in relation to said surface, rise of said holdfast-beam above said stack being terminated when non-actuated ones of said sensors are present over a definite distance.

6. An arrangement for cutting as defined in claim 5, wherein said sensors comprise light barrier means.

* * * * *